United States Patent [19]

Fleenor et al.

[11] 4,174,722

[45] Nov. 20, 1979

[54] CLEANING APPARATUS FOR SAMPLE CONTAINERS IN A QUEUE

[75] Inventors: Richard P. Fleenor; Henry W. Cassady, Jr., both of Santa Cruz, Calif.

[73] Assignee: Manning Environmental Corp., Santa Cruz, Calif.

[21] Appl. No.: 918,470

[22] Filed: Jun. 23, 1978

[51] Int. Cl.[2] ..... B08B 3/02; B67C 1/00

[52] U.S. Cl. ..... 134/62; 134/80; 134/142; 134/152; 62/336; 141/91

[58] Field of Search ..... 134/43, 52–53, 134/62, 78–81, 105, 140, 142, 152, 165, 166 R–168 R, 200; 62/336; 141/89, 91–92; 222/146 C

[56] References Cited

U.S. PATENT DOCUMENTS

| | | | |
|---|---|---|---|
| 2,418,691 | 4/1947 | Bjering et al. | 134/81 |
| 3,226,757 | 1/1966 | Shea | 134/81 X |
| 3,495,291 | 2/1970 | Copping et al. | 134/167 R X |
| 4,098,305 | 7/1978 | Gates | 141/92 |

FOREIGN PATENT DOCUMENTS

| | | | |
|---|---|---|---|
| 269674 | 3/1969 | Austria | 134/62 |
| 296277 | 1/1917 | Fed. Rep. of Germany | 62/336 |
| 1188412 | 3/1965 | Fed. Rep. of Germany | 134/79 |
| 1432296 | 12/1968 | Fed. Rep. of Germany | 134/80 |
| 1154502 | 11/1957 | France | 134/62 |

*Primary Examiner*—Robert L. Bleutge

[57] ABSTRACT

Apparatus for emptying successive sample containers, by inverting the containers, one at a time, draining the contents of each container, washing, again draining each container and restoring each container to its initial position. Each container is held in a holder mounted for rotation in a vertical plane about a hinge near the bottom of the holder. A hook is adapted to engage a holder and pivot about a separate hinge bringing the holder and its container to an inverted position where a nozzle sprays washing fluid into the inverted sample container. After draining, the sample container is restored to an upright position.

9 Claims, 7 Drawing Figures

CLEANING APPARATUS FOR SAMPLE CONTAINERS IN A QUEUE

BACKGROUND OF THE INVENTION a. Field of the Invention

The invention generally relates to fluent material handling apparatus and more particularly to a sample container washing and draining apparatus for a sampler having successive sample containers.

b. Prior Art

In a prior application, now U.S. Pat. No. 4,098,305 entitled Continuous Liquid Sampling Apparatus and Method, assigned to the assignee of the present invention, a continuous sampler is disclosed in which sample containers arranged in a queue are each successively moved to a position where a sample hose or probe is inserted into the sample container to remove fluid sample material by suction. After sample removal, another hose or probe directs a wash solution into the sample container which is removed after washing through the same or another hose or probe. The sample container is tilted approximately thirty degrees during these operations but fluids still enter and leave the sample container while it is generally in an upright position.

While this type of fluent handling is useful in sampler applications where low amounts of sample cross-contamination are tolerable, it is not useful where such low amounts of sample cross-contamination are intolerable. In continuous samplers of the type described in said prior application, and similar devices which inject and withdraw samples through the top of the sample containers, about one to two per cent of the sample and washing solution remains after sample removal and washing are completed. When using samplers to detect low concentrations of materials which may affect public health, such cross-contamination taints sample measurements. Continuous samplers are useful in remote sampling of rivers, sewers and the like where unattended, continuous sampling, such as one-an-hour, around-the-clock, is necessary. Increasing concern for measurement accuracy in certain applications, such as public health, requires substantial reductions in sample cross-contamination.

SUMMARY OF THE INVENTION

An object of the invention was to devise a sample container handling device for minimizing sample cross-contamination in fluid sample, removal from a container, washing of the container and refilling with another sample.

This object has been achieved in an apparatus for emptying, washing and draining successive individual sample containers prior to refilling with further samples. A queue of movable sample container holders is provided with each holder having a means for securing a sample container therein with the container facing generally upward. Each holder is hinged to a guide member near the bottom of the holder so that the holder may rotate in a vertical plane about the guide member.

A sample container inverting means is provided for causing holder rotation about the hinge such that the sample container rotates in a vertical plane to almost an upside down position whereby sample material in the container is drained out. The sample container inverting means comprises a pivotally mounted, motor actuated, hook which engages the sample container holder and causes holder rotation about its hinge. At the bottom or base of the sample container rotational locus, a nozzle is disposed for spraying a fluid stream under pressure in a predetermined upward trajectory into an inverted sample container or bottle so that a washing fluid stream entering the sample container will wash the container and drain out by gravity flow. Any sample material still remaining in the container as by adhesion to container walls, is removed.

A motor is provided for indexing the queue of movable sample containers for bringing each sample container in the queue into alignment with the nozzle. The sample containers may be mounted in a carousel arrangement for continuous sampler operation.

After a sample container is inverted to an upside down washing position and is washed and drained, the sample container is then pulled back into an upright position and the sample container queue is indexed by a distance corresponding to one sample container such that the next sample container in the queue, when inverted, will have its interior exposed to the nozzle for washing and draining. Using this apparatus, sample cross-contamination in the same container is substantially reduced.

FIGS. *3a, 3b, 3c* and *3d* show a sequence of positions for tipping a sample container of the present invention from an upright to a generally upside down position.

Figure 1:
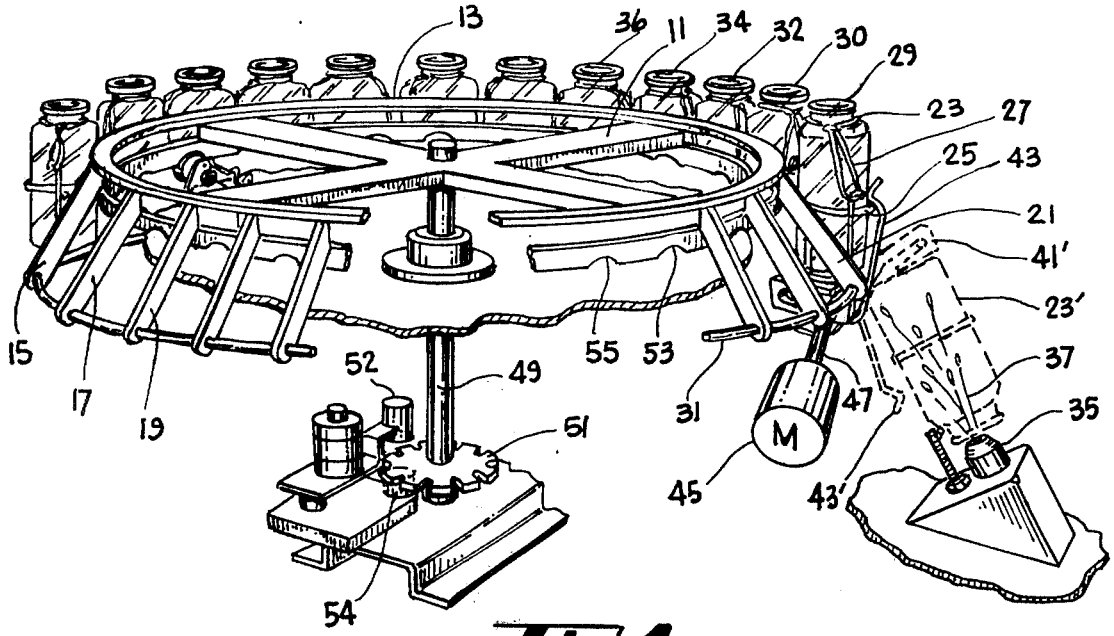
FIG. 1 is a perspective view of the sample container emptying, washing and draining apparatus of the present invention.
Figure 4:
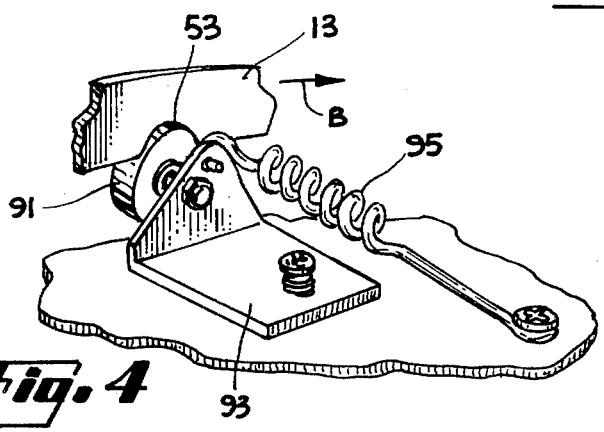

FIG. 4 is a perspective detail of a detent mechanism in the apparatus of FIG. 1.

DESCRIPTION OF THE PREFERRED EMBODIMENT

With reference to FIG. 1, a carousel wheel 11 has a rim 13 which forms the inner periphery of a queue of sample containers. Although the rim 13 is circular and rigid, it need not be so. A flexible rim, formed by a belt which moved along a belt-driven noncircular path would work equally well. A carousel wheel was selected because it is relatively compact, easy to index and if refrigeration is desired, allows for placement of ice or other refrigeration means in the center of the wheel. Mounted to the sides of rim 13 are fins 15, 17, 19 and so on, with each fin having a rigid metal or plastic construction and is cantilevered outwardly and downwardly from the rim 13. The space between fins defines a sample container position. The fins serve to provide lateral support for the sides of a sample container, while rim 13 provides support against the back of a sample container.

A sample container 23 may be seen to be in an upright position supported by fin 21. The sample container 23, which is a glass bottle as an example, is held in a movable holder 25 which is a wire framework surrounding the base of the sample container into which the bottle may be inserted. The bottle is held in the holder 25 by means of an expansible band 27 which extends from one side of holder 25 over the narrowed neck 29 of sample container 23 and thence to the other side of holder 25 where the band is secured. By removing the band 27 from neck 25 a sample container may be removed from its holder without disengaging the band from the holder.

The base of each holder is hinged to a circular guide member 31 which is generally parallel to rim 13. The guide 31 is near the bottom front of the holder 25 slightly above the lowermost extent of the holder and on the side of each holder which is furthest from rim 13. Rim 13 may be considered to be behind each holder while guide 31 is in from of each holder.

A wash station is a sample container temporary position provided with a nozzle means 35 positioned generally beneath the holder queue, at approximately a five o'clock position, for directing a washing fluid stream in a predetermined upward trajectory shown by the dash lines 37. Nozzle means 35 is connected by means of hoses to a supply of washing fluid which is pumped under pressure through the nozzle on command.

Nozzle 35 is operated after a container, shown by the phantom lines 23' is rotated by a container inverting means to a generally upside down position such that any sample fluid therein is drained and the container is then washed by a washing fluid injected into the container by the nozzle 35. The washing fluid follows an upward trajectory into the bottle and by hydro static pressure washes the walls of the sample container, removing caked debris therefrom. Washing fluid is then drained by gravity from the inverted container 23'.

The container is pulled upright by the container inverting means which is mounted at the wash station for causing holder rotation about the holder hinge. The container inverting means includes a hook 41 which is described hereinafter as well as a pusher plate 43 which is used to restore the sample container to its upright position. A motor 45 drives shaft 47 which is connected to the hook 41. While the sample container 23' is inverted, the band 27 holds the sample container in its holder. The queue of sample containers 29, 30, 32, 34, 36, etc. is advanced by an indexing means associated with the queue.

As mentioned previously, each holder for a sample container is mounted on guide 31 which is fixed relative to fins 15, 17, 19, etc. The fins in turn are fixed to rim 13 and thus to wheel 11. Wheel 11 is turned by a central drive shaft 49 which has a sensor wheel 51 with slots therein, each slot equally spaced about the wheel corresponding to a sample container position. A photocell 52 is positioned above the wheel for directing light through a slot. A photodetector 54 is positioned below the wheel to detect light coming through a slot. Each time the photodetector intercepts light it is indicative of advancement of the next holder to wash station. A problem is that a sample container is not precisely centered at a wash station by the photocell and detector. The photocell and detector provide approximate centering only. In order to achieve more precise centering, a plurality of spaced apart detents 53, 55, etc. are provided along the rim 13. Such detents engage a fixed spring mounted wheel which aligns the center of a sample container with the wash station, as discussed with reference to FIG. 4, below.

Figure 2:
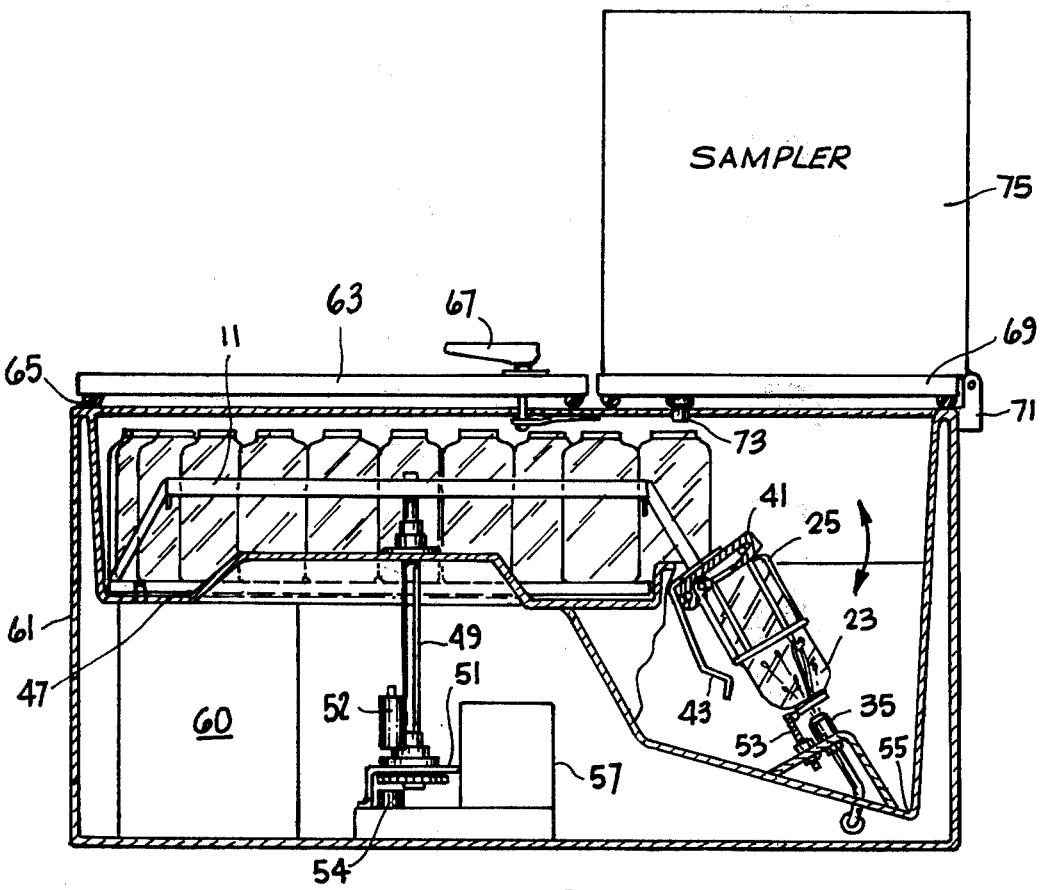
FIG. 2 is a side elevation of the apparatus of FIG. 1, shown to be housed in a weathertight housing in combination with a sampling apparatus.

With reference to FIG. 2, a weathertight housing 61 is shown enclosing the carousel wheel 11 which provides locomotion for a queue of movable holders with sample containers therein. Hook 41 is shown restraining holder 25 in an upside down position such that the sample container 23 has its top opening into nozzle 35 at a position which is referred to as a five o'clock position, a generally inverted position for the sample container 23. An arm or bar 53 restrains the sample container from rotating further beyond the five o'clock position. This position is selected for convenience and other positions, such as a six o'clock position, could also be used.

The upside down position which is selected must be one which allows drainage of sample material from the sample container as well as allowing drainage of cleansing fluid injected by the nozzle 35. A sump 55 is provided which drains drains washing fluid, as well as sample material, from the sample container 23. After the sample container has been washed and drained, the hook 41 is rotated in a counterclockwise direction pulling the holder 25 and the sample container therein back to its starting position. The pusher plate 43 comes into contact with the sample container once the hook 41 is released from the holder when the sample container is in an upright position, making sure that the sample container remains in an upright position after the hook 41 is removed from holder 25. After contact, pusher plate 43 and the connected hook 41 are rotated a few degrees clockwise again such that the pusher plate is not touching the sample container and allowing clearance so that the queue may advance automatically or on command and the next sample container holder can be engaged by hook 41.

A circular tray 47 is provided to isolate the sample containers from the sensor wheel 51, drive shaft 49 and the control unit housing 57. A battery power supply and an optional refrigeration source 60 may occupy the lower portion of housing 61 beneath the tray 47. Housing 61 is provided with a first door 63 having a pivot 65 and a handle 67 for gaining access to the sample containers. By raising door 63 access may be had to the sample containers when desired. Another door 69 has a pivot 71 and meets door 63 to form a sealed closure for the apparatus. Door 69 has an aperture 73 penetrating it so that a sampler 75 can communicate with a sample container at the wash station, prior to washing and immediately thereafter. The function and operation of such a sampler is explained in the previously mentioned U.S. Pat. No. 4,098,305 and incorporated by reference herein.

Such a sampler typically has provisions for drawing fluid from a sample container, making a measurement and then discharging the sample back into the sample container. The queue of sample containers of the present invention provides a means for storing samples for a predetermined amount of time. For example, if the queue is circular and houses 24 bottles, and one bottle is sampled each hour, the queue will preserve samples for a 24-hour period. In this manner, the entire apparatus may be located at a remote site for automated, unattended sample analysis. Sample data may be transmitted by radio or wire to a data analysis location and only in the event of an unusual condition would the housing 61 be opened to examine a sample container. In this mode of operation, the sampler 75 draws a sample, makes a measurement and deposits the sample through orifice 73 into a sample container. The position of the carousel wheel may be logged by the position wheel 51 which may communicate with a data logging device. The queue is then indexed by one sample container which has just completed a complete revolution of the wheel since the time the sampler was filled the sample container has most of its contents removed by suction from a probe inserted from the sample sampler through orifice 73 into the sample container, which is then inverted, drained of remaining sample material, washed and pulled upright as previously described and a new sample is allowed to fill the sample container. Afterwards, the queue is again indexed by one sample container.

As a minimum, the sampler has a base with an aperture therein communicating with sample containers thereunder. The base is mounted above the queue of sample containers in the respective holders with vertical clearance such that the sample containers can pass beneath the base. Typically, one or more probes may move through the orifice into the sample containers, although such probes are not necessary.

Figure 3A:
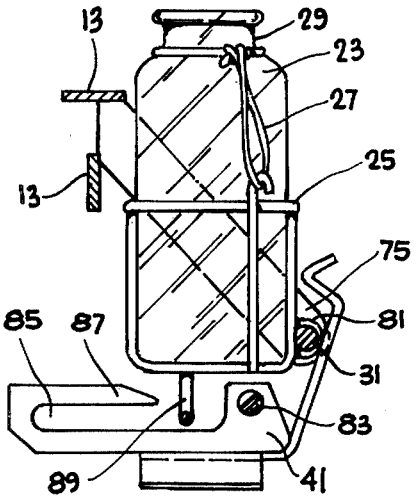

With reference to FIG. 3*a*, the sample container tipping means is shown to include a holder 25 which is typically a wire frame which has means for connecting the band 27 to each side thereof. Band 27 is adapted to grasp neck 29 of the sample container 23. A fin 75 is shown to be extending outwardly from rim 13 of wheel 11. Fin 75 helps maintain holder 25 in a properly spaced position and rotates in a flat plane since it is connected to the wheel 11 and rim 13. Holder 25, besides rotating in a flat plane rotates in a vertical plane about guide 31, which passes through an end of the fin 75. Guide 31 is a heavy wire which passes through each fin and has a portion of the holder 25 mounted about the guide 31 in a loop or ring 81 such that the holder can be tipped in the vertical plane about the guide 81 to an inverted position.

Hook 41 is also mounted for rotation in the vertical plane about a different hinge or pivot point 83 which is offset from guide 31 a sufficient distance such that the hook 41 and the holder 24 have distinct centers of rotation. This is necessary in order to enable the hook 41 to engage the holder and later disengage it. Hook 41 defines a hollow core 85 and a folded nose portion 87 having a wedge surface for insertion into a lower tang 89 attached to holder 25.

Figure 3B:
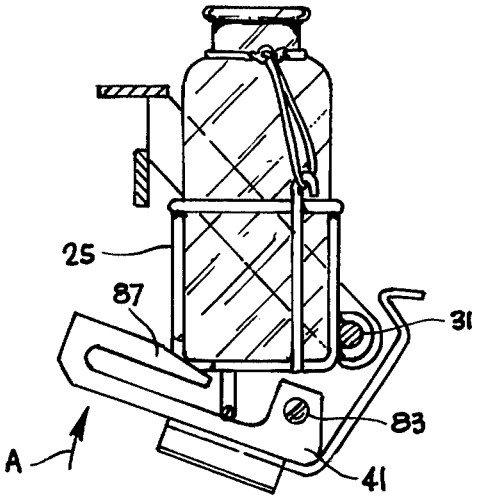
Figure 3C:
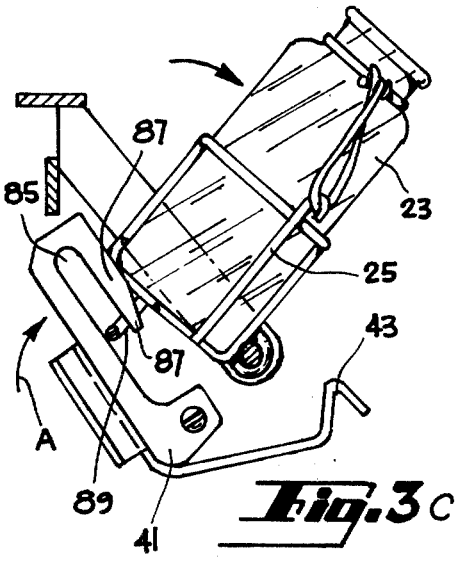

In FIG. 3*b*, the hook 41 is rotated in a clockwise direction such that the nose 87 nudges the holder 25 and container 23 mounted therein imparting clockwise rotational force thereto. Hook 41 rotates about the hinge point 83 whereas holder 25 rotates about guide 31, as indicated by the arrow A.

In FIG. 3*b*, the nose 87 may be seen to have entered the loop defined by tang 89 connected to holder 25 so that the rotation of the sample container 23 can be controlled by restraint within the core 85 of hook 41. At the same time, the nose 87 is still nudging holder 25 toward further clock-wise rotation.

Figure 3D:
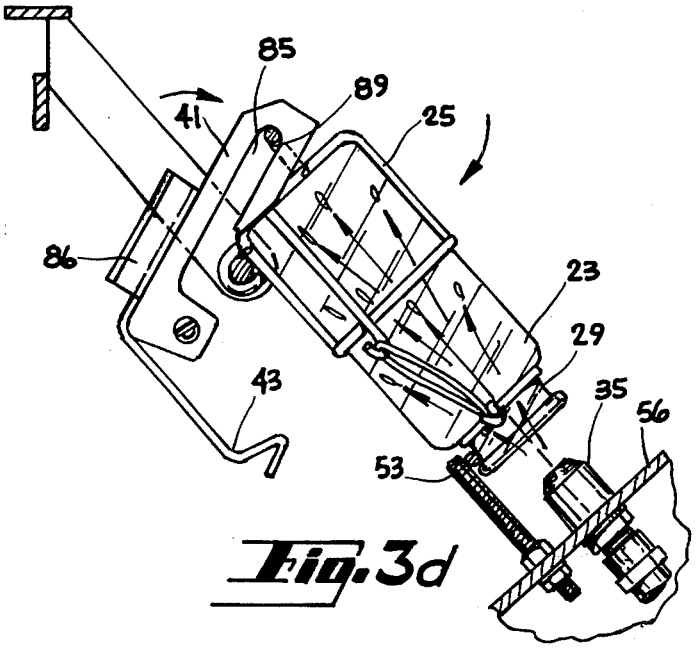

In FIG. 3*d*, further rotation of the hook 41 or the holder 25 is stopped by a limit switch, not shown. Bar 53 is mounted against a plate 56 for positioning neck 29 such that the sample container 23 opens directly into the nozzle 35. Once the sample container 23 is allowed to drain and washing fluid is directed into the bottle and also allowed to drain, hook 41 is rotated in a counterclockwise direction as previously described until the position shown in FIG. 3*a* is reached. Then further counterclockwise motion is provided until the pusher plate 43 contacts the bottle and pushes it back against rim 13 and then rotates clockwise to the position shown in FIG. 3*a*, clear of the sample container 23 and its holder 25 so that the queue may be indexed by one or more sample container positions.

While the sample container 23 is inverted, as shown in FIG. 3*d*, water which has been previously used in washing vials and tubing within sampler 75, shown in FIG. 2, is dumped from sampler 75 through orifice 75 onto deflector plate 86 which diverts the downward stream of dirty water toward the bottom of the sample container housing and away from nozzle 35. Sampler 75 is permitted to dump dirty wash water only while sample container 23 is in the inverted position of FIG. 3*d*, generally during the same time that the interior of the sample container is being washed by a fluid stream from nozzle 35.

FIG. 4 shows a detent 53 of rim 13 engaging a spring mounted wheel 91 which is secured to plate 93 and pulled upwardly by spring 95. Motion of rim 13 in the direction of arrow B causes downward motion of the plate 13 allowing the wheel 91 to be removed from the detent 53 until the next detent is encountered. In this way, a sample container is centered at a wash station where the nozzle 35 is disposed.

What is claimed is:

1. Apparatus for cleaning individual containers, such as bottles or the like, in a queue comprising, a queue of container holders, each holder having means for securing a container therein with a container opening facing generally upwardly, and a guide member to which each holder is hinged, nozzle means disposed at a wash station beneath said holder queue for directing at least one washing fluid stream in a predetermined upward trajectory means for indexing said holder queue to bring said containers into alignment with said wash station, and container inverting means for causing holder rotation about said hinge transverse to said queue to a generally upside down container position, bringing a holder and the opening of a container secured therein into alignment with the fluid stream trajectory of said nozzle means and later for causing holder rotation about said hinge, restoring said holder to its initial position, said container inverting means comprising a pivotally mounted hook mounted near said wash station for rotatably engaging a holder and causing holder rotation about said hinge.

2. The apparatus of claim 1 wherein said container inverting means further includes a fixed holder stop for positioning an inverted container proximate to said nozzle means.

3. The apparatus of claim 1 wherein said queue of containers is circular and said container inverting means causes holder rotation radially outwardly.

4. The apparatus of claim 1 wherein said holder and said hook have distinct centers of rotation.

5. The apparatus of claim 1 wherein said holder has a tang below said holder adapted to receive said hook.

6. An improved apparatus for washing containers, such as bottles or the like, comprising, a hinged container holder having means for securing a container therein with a container opening facing generally upwardly, a wash station having a nozzle means disposed beneath said holder for directing a washing fluid stream in a predetermined upward trajectory, and container inverting means for causing holder rotation about said hinge to a generally upside down container position, bringing a holder and the opening of a container secured therein into alignment with the fluid stream trajectory of said nozzle means and later for causing holder rotation about said hinge, restoring said holder to its initial position, said container inverting means comprising a pivotally mounted hook mounted near said wash station for rotatably engaging a holder and causing holder rotation about said hinge.

7. The apparatus of claim 6 wherein said container tipping means further includes a fixed holder stop for positioning an inverted container proximate to said nozzle means.

8. The apparatus of claim 6 wherein said holder and said hook have distinct centers of rotation.

9. The apparatus of claim 6 wherein said holder has a tang below said holder adapted to receive said hook.

* * * * *